US007493853B2

(12) United States Patent
Xue

(10) Patent No.: US 7,493,853 B2
(45) Date of Patent: Feb. 24, 2009

(54) CARDBOARD BALER

(76) Inventor: Guanghui Xue, 31 Rue das Anciens, Gatineau, Quebec (CA) J8T 3T3

( * ) Notice: Subject to any disclaimer, the term of this patent is extended or adjusted under 35 U.S.C. 154(b) by 0 days.

(21) Appl. No.: 11/443,523

(22) Filed: May 31, 2006

(65) Prior Publication Data

US 2007/0277684 A1 Dec. 6, 2007

(51) Int. Cl.
*B65B 13/20* (2006.01)
*B65B 13/02* (2006.01)

(52) U.S. Cl. ..... 100/3; 100/29; 100/32; 100/280; 53/590

(58) Field of Classification Search ..... 100/1, 100/3, 8, 29, 30, 32, 33 R, 34, 260, 262, 280, 100/288, 299, 915, 214; 53/589, 590
See application file for complete search history.

(56) References Cited

U.S. PATENT DOCUMENTS 1,197,824 A * 9/1916 Hess ..... 100/288
1,342,981 A * 6/1920 Bluege ..... 100/31
1,353,973 A * 9/1920 Ornston ..... 254/234
2,476,574 A * 7/1949 Aluotto ..... 100/244
2,933,314 A * 4/1960 Stobb ..... 271/215
4,146,942 A * 4/1979 Westra et al. ..... 412/10
4,196,663 A * 4/1980 Pasic ..... 101/27
4,229,650 A * 10/1980 Takahashi et al. ..... 250/223 R
4,373,843 A * 2/1983 Lang ..... 412/10
6,189,443 B1 * 2/2001 Hilford ..... 100/212

FOREIGN PATENT DOCUMENTS

GB 164961 6/1921
GB 1041180 12/1964
JP 58218399 A * 12/1983

* cited by examiner

*Primary Examiner*—Jimmy T Nguyen
(74) *Attorney, Agent, or Firm*—Miltons LLP

(57) ABSTRACT

A baler, comprising a compacting mechanism and a binding mechanism is provided. The compacting mechanism comprises a bearing plane against which cardboard is compressed. This baler includes a compacting mechanism and rope tightening mechanism. In using the baler of the invention, a cardboard compacting platform is pulled up towards the compacting bearing plane along a channel in a frame. The compacting platform is pulled up by mechanical force and dragged downwards by its weight. A rope clamp placed on each side of the rack combine with the rope retracting ratchet gear and other elements from a rope tightening mechanism to tie up the compacting cardboard.

3 Claims, 5 Drawing Sheets

CARDBOARD BALER

BACKGROUND TO THE INVENTION

There are presently automatic electro/hydraulically driven cardboard compactors that are big in size, high in cost and stationary. Most cardboard recycling situations require a cardboard baler that is easy to use, low in cost, and mobile for the working environment. The primary objective of the present invention is to provide a new cardboard baler that meets these needs.

SUMMARY OF THE INVENTION

The broad aspect of the present invention is an apparatus for baling cardboard.

This invention comprises according to a preferred variant an upright metal rack, a cardboard compacting mechanism and a rope tightening mechanism. The steel rack is an upright structure defined by one inclined plane, and three vertical planes. The inclined plane is occupied by two parallel channels facing each other.

Located on the upper end of the rack and fixed perpendicularly to the inclined plane, is a compacting bearing plane. On the rearward side of the rack, opposite from the inclined plane and on opposite sides of the rack, a pair of generally upright members extend from the base to connect respectively with the upper ends of a pair of longitudinal rack plane members respectively extending in line with respective parallel channels extending along the sides of the inclined plane. The respective upright members and longitudinal rack plane members each meet at a respective upper apex. A pair of transverse longitudinal members extend respectively on each side of the rack between one of the generally upright members and the corresponding parallel channel connected to such one generally upright member, bracing the rack and extending further outwardly from the inclined plane to define and support the compacting bearing plane. Under the fixed compacting bearing plane and perpendicular to the inclined plane is the movable compacting platform.

Four sliding pins attached to the movable compacting platform slide in the parallel channels.

A winch is located at the upper end of the rack on the center vertical plane. A strap, which serves as a flexible, tension-bearing linkage connects the winch and the movable compacting platform. When the winch is retracted the movable compacting platform moves up towards the compacting bearing plane. When the winch is released, it causes the lower, movable compacting platform to slide downwards away from the compacting bearing plane by its own weight.

The rope tightening mechanism comprises two rope clamps carried by the frame which serve as rope restraining means, a rope retracting shaft and a ratchet gear. The ratchet gear turns the rope retracting shaft to retract the rope for tying. The rope clamp is used to hold the tightness of the rope while tying the knot.

BRIEF DESCRIPTION OF THE DRAWINGS

In the drawings which form a part of this specification.

DETAILED DESCRIPTION OF THE INVENTION

Figure 1:
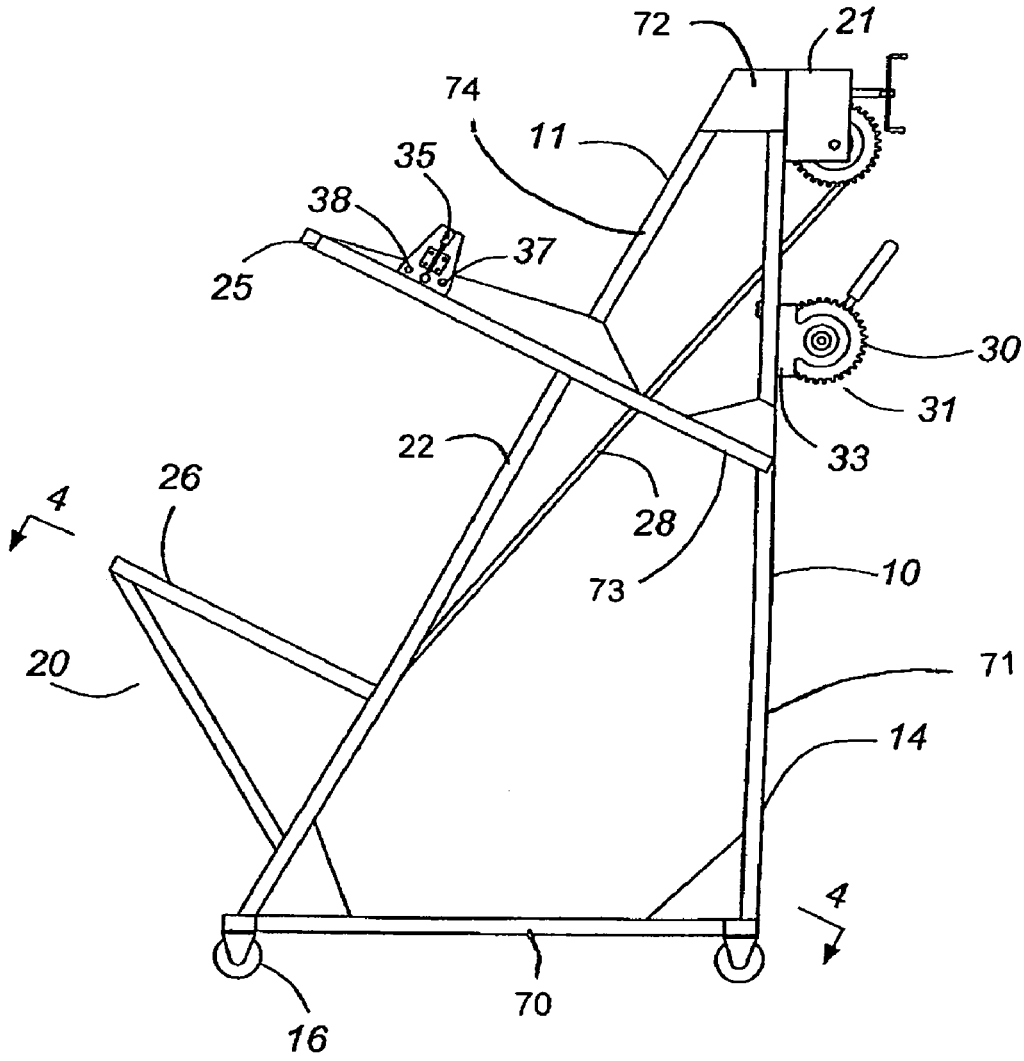
FIG. 1 is a side view of the baler.
Figure 2:
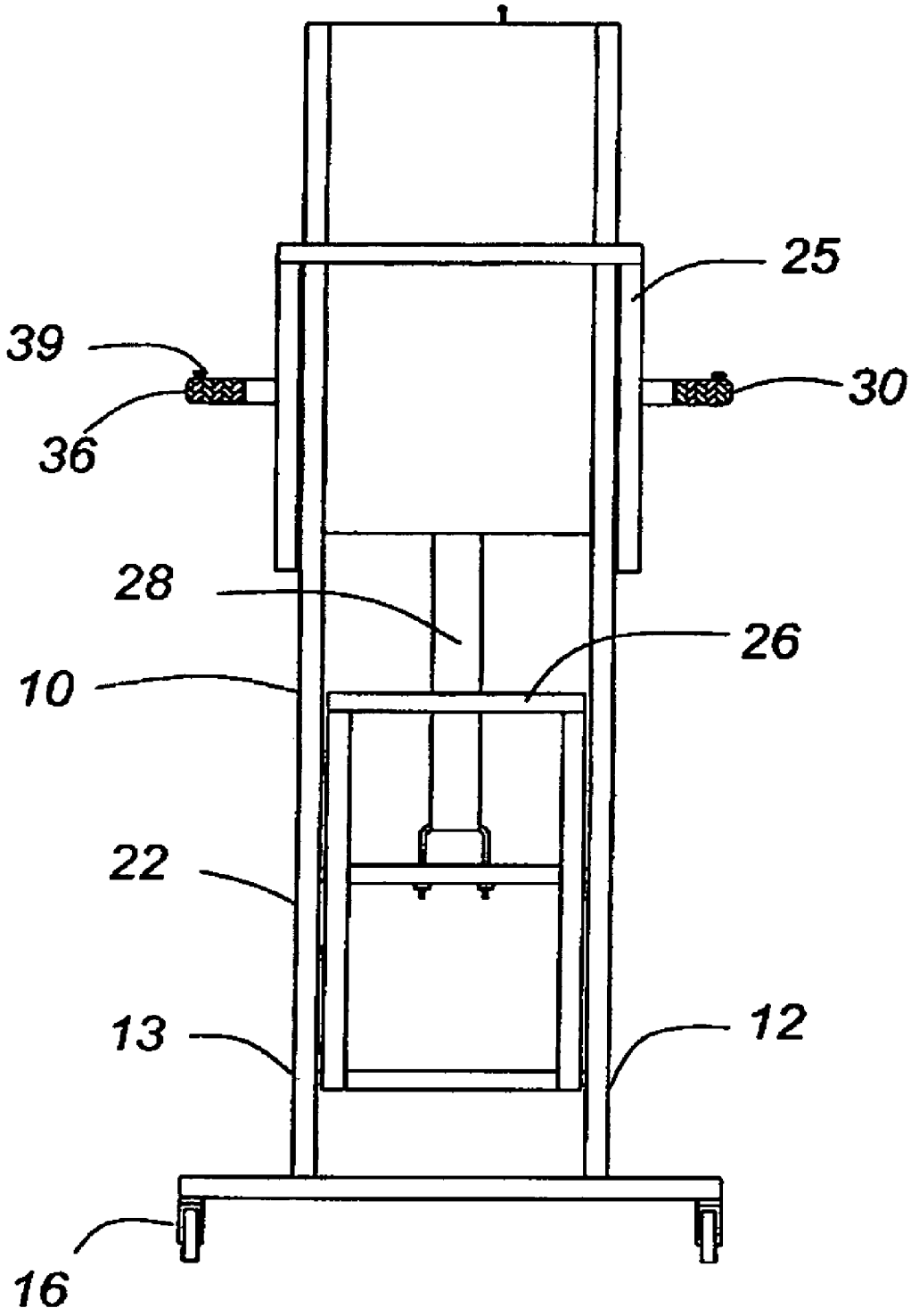
FIG. 2 is a front view of the baler.
Figure 3:
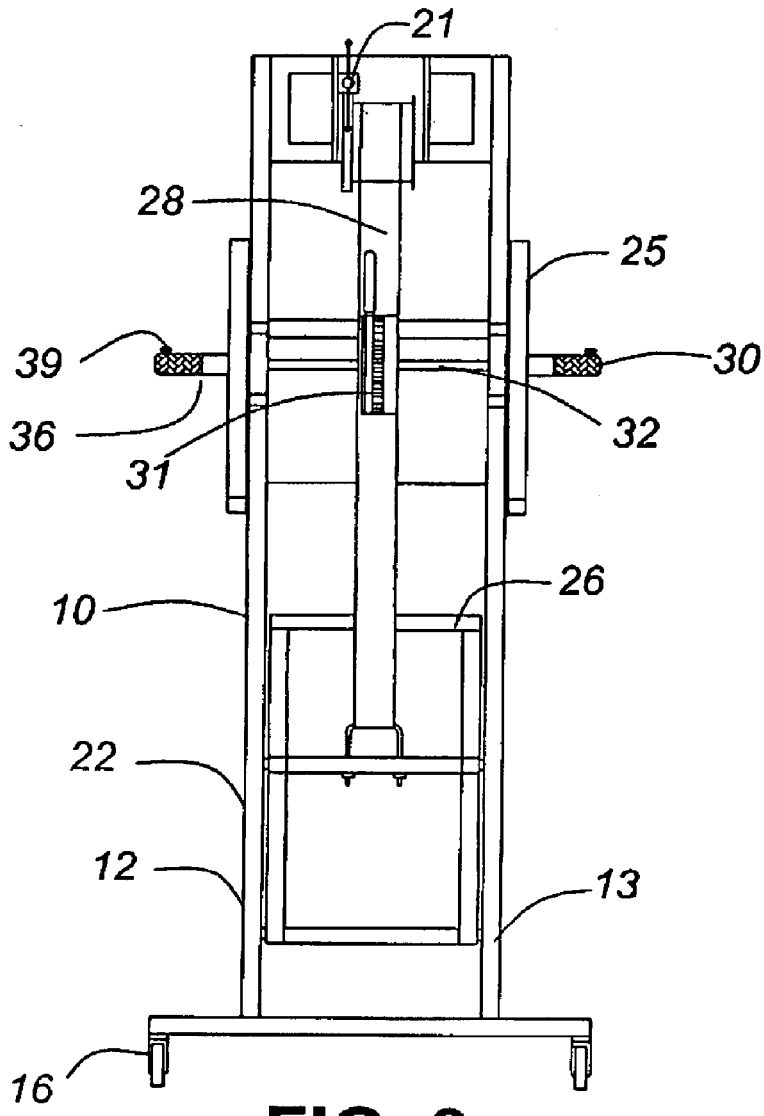
FIG. 3 is a rear view of the baler.
Figure 4:
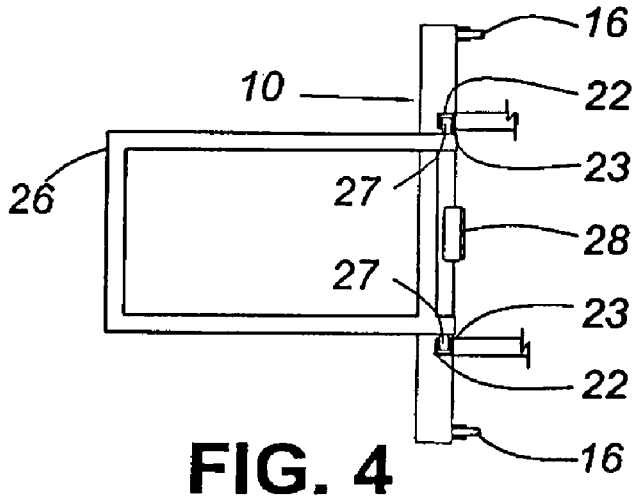
FIG. 4 is a cross-section view of the line A-A of FIG. 1, showing the sliding pins of the compacting platform in the slots of the channels with some parts deleted for the clarity of illustration.

The cardboard baler shown in the FIG. 1 is a mobile upright metal rack 10 with a cardboard compacting mechanism 20, and a rope tightening mechanism 30.

The rack 10 is an upright metal structure that is delimited by one inclined plane 11 and three vertical planes. The three vertical planes are made up of the left plane 12, right plane 13, and rear side plane 14. Located under base 70 of the rack 10, there are four wheels 16.

The inclined plane 11 is bounded by two slotted steel channels steel 22 parallel to each other. The slots 23 of the channels 22 face each other.

Located on the upper end of the rack 10 and perpendicular to the inclined plane 11, is the compacting bearing plane 25. On the rearward side of the rack 10, opposite from the inclined plane 11 and on opposite sides of the rack 10, a pair of generally upright members 71 extend from the base 70 to connect respectively with the upper ends of a pair of longitudinal rack plane members 74 respectively extending in line with respective parallel channels 22 lying along the sides of the inclined plane 11. The respective upright members 71 and longitudinal rack plane members 74 meet at a respective upper apex 72. A pair of transverse longitudinal members 73 extend respectively on each side of The rack 10 between one of the generally upright members 71 and the corresponding parallel channel 22 or a longitudinal rack plane member 74, bracing the rack 10 and extending further outwardly from the inclined plane 11 to define and support the compacting bearing plane 25. Under this fixed compacting bearing plane 25 and perpendicular to the inclined plane, is the movable compacting platform 26. Four sliding pins 27 located on the movable compacting platform 26 slide in the slots 23 of the parallel channels 22 guiding the compacting platform 26 as it moves up and down.

A commercially available winch 21 is located at the upper top of the rack 10 at the upper end of the rear side plane 14. The winch 21 and the movable compacting platform 26 are connected by a strap 28. The movable compacting platform 26 is pulled upwardly towards the compacting bearing plane 25 along the inclined plane 11 by the winch's 21 mechanical power and slides down by its own weight.

A rope retracting ratchet gear 31 turns a rope-retracting shaft 32 that fits in two shaft brackets 33.

A rope toggle clamp 35 is mounted on each outer side of the compacting bearing plane 25. On one side of the toggle clamp 35 towards the rope retracting shaft 32, there is a rope hook pin 37 to serve as an anchor. On the other side of the toggle clamp 35 away from The rope retracting shaft 32, there is a rope guide 38. At each end of the rope retracting shaft 32, there is a rope retracting roller 36 and a rope locking pin 39.

In bailing process of the cardboard the operator places flatted loose cardboard 40 on the movable compacting platform 26. The operator then turns the handle of the winch 21 to retract the strap 28 pulling up the movable compacting platform 26. This causes the loose cardboard 40 to be formed into the compacted cardboard 50.

Figure 5:
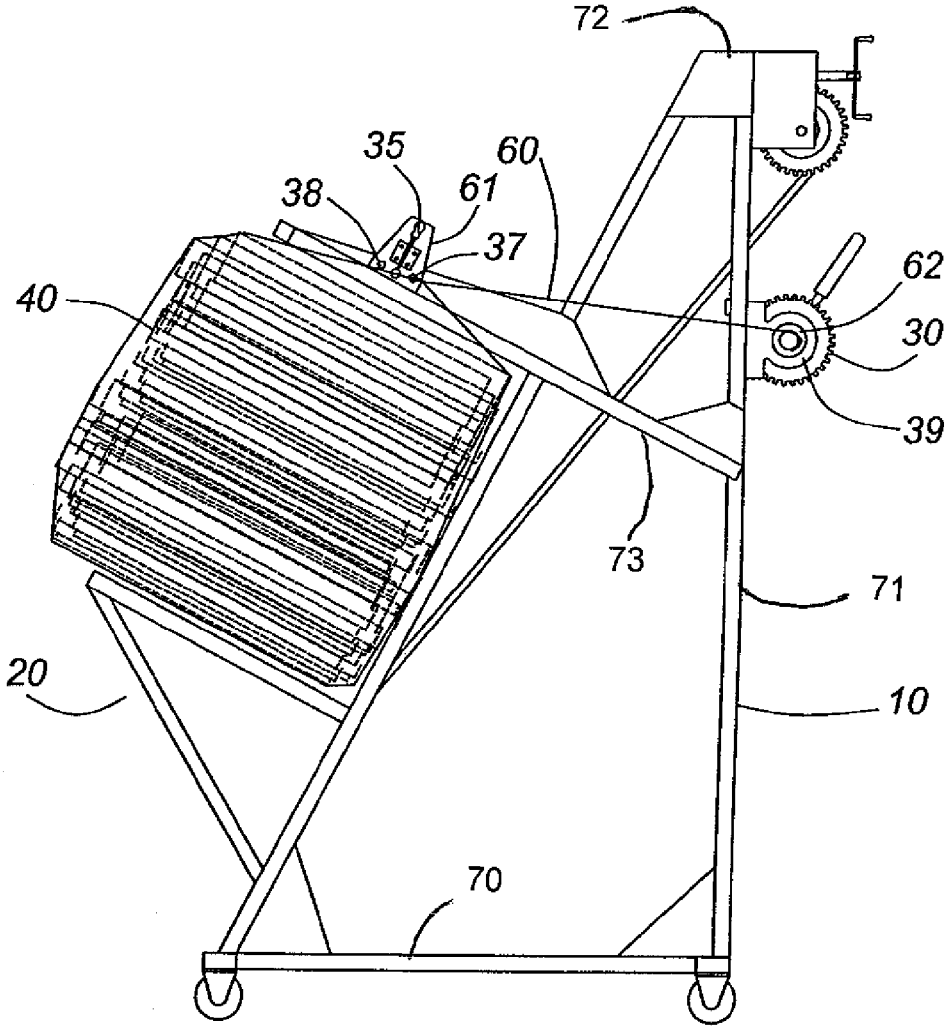
FIG. 5 is a side view of the baler showing the apparatus loaded with loose cardboard before the process of baling, as well as a rope which has been placed around the loose material and attached to the clamps and winch.
Figure 6:
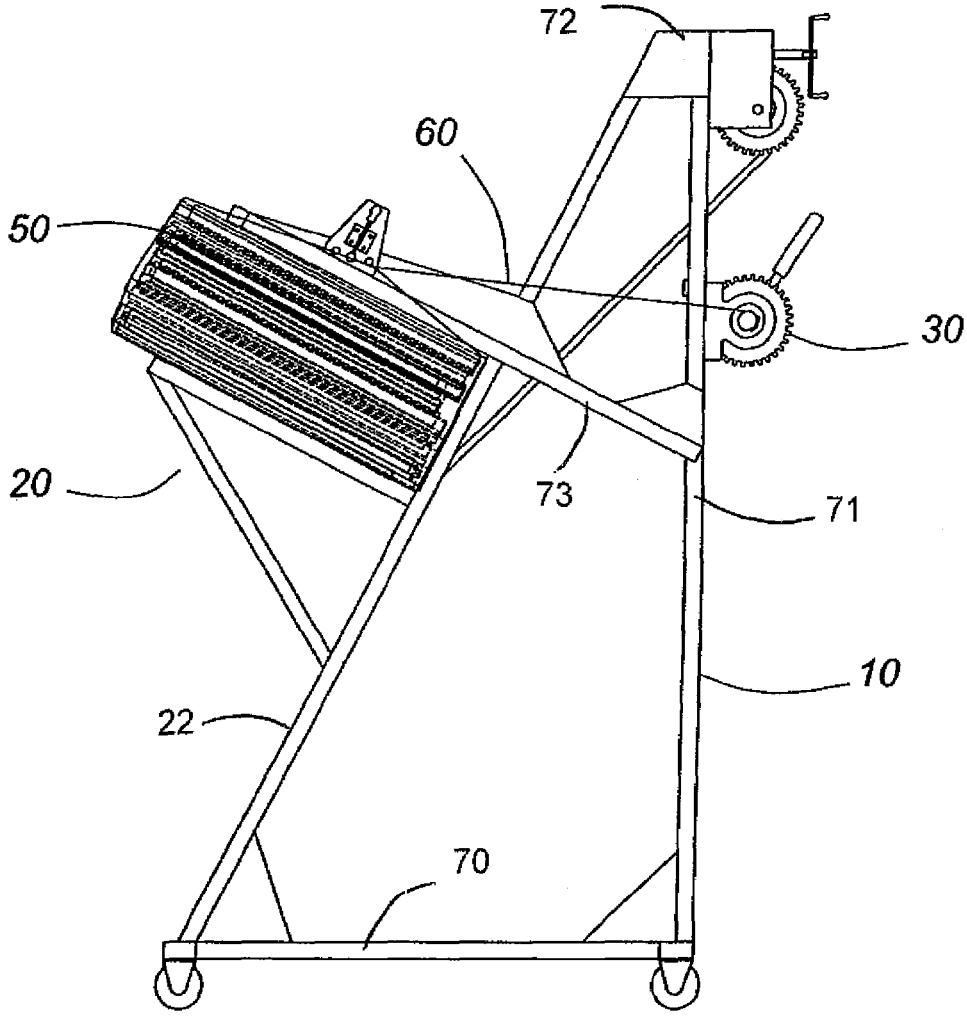
FIG. 6 is a side view of the baler showing the apparatus in the baling position compressing cardboard into a compacted form, as well as a rope which has been placed around the compacted cardboard and attached to the clamps and winch.

To bind the bundle of compacted cardboard 50, the operator uses a length of rope 60 and makes an end loop at the end of it. The operator places the end loop on the rope hook pin 37. The operator then winds the free end of the rope 60 clockwise in FIG. 5 around loose cardboard 40, placing the rope 60 along the rope guide 38, aligning the rope 60 with the opened rope toggle clamp 35. Then the operator winds the free rope end onto the rope locking pin 39 and screws down the rope friction pin 39 to hold the end of the rope 60 fast to the rope retracting roller 36.

The operator turns the handle of the rope retracting ratchet gear 31 tightening the rope 60 until the rope reaches optimum tightness. Then the operator clamps down the toggle clamp 35 to hold tight the retracted rope 60. The operator then releases the rope locking pin 39 and makes a knot by tying the loose end of the rope and the rope loop together while the rope 60 is held tight by the toggle clamp 35, see FIG. 5. The operator then turns the winch 21 handle to release strap 28 lowering the movable compacting platform 26. The operator then removes the tied compacted formed cardboard 50 from the baler completing the working cycle of the baler.

CONCLUSION

The foregoing has constituted a description of specific embodiments showing how the invention may be applied and put into use. These embodiments are only exemplary. The invention in its broadest, and more specific aspects is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which as exclusive property privilege is claimed are defined as follows:

1. A baling device for compacting an amount of material into a bundle comprising:

a) a rack;

b) a compacting bearing frame fastened to the rack;

c) a movable compacting platform for receiving material to be compacted slideably connected to the rack for sliding along the rack towards the compacting bearing frame;

d) force applying means for moving said movable compacting platform towards the compacting bearing frame to compact the material between the movable compacting platform and the compacting bearing frame, the force applying means being mounted on the rack and connected to the movable compacting platform through a flexible tension-bearing linkage wherein the rack comprises:

e) a base with a pair of vertical members extending from the base, and f) an inclined rack plane along which the compacting platform moves, the inclined rack plane being oriented at an angle to the base, extending inwardly and upwardly from the front side of the base, and further comprising:

g) rope anchors respectively mounted on each outer side of the compacting bearing frame for anchoring an end of a rope, h) a rope tightening mechanism including a rope retracting means with a plurality of rope engagement elements, the rope retracting means being connected to the pair of vertical members, and i) a rope restraining means mounted on each outer side of the compacting bearing frame for holding the tightness of the rope while tying a knot therein, the rope restraining means including a rope clamping element, wherein each of the rope anchors is positioned to hold a first looped end of a rope in place, and a respective rope engagement element is positioned to hold the other end of the rope in place while said rope is tightened about the material by the rope retracting means to form a bound bundle, and wherein the rope clamping element is positioned to be clamped down to hold the tightened rope around the material while the other end of the rope is released from the rope engagement element to form a loose end of the rope in order to allow an operator to tie the first looped end and the loose end of the rope together to form the knot.

2. A baling device as in claim 1 comprising a pair of parallel channels provided along the respective sides of the rack plane, the movable compacting platform being connected to slide along said pair of parallel channels.

3. A baling device as in claim 2 wherein the force applying means operates to wind the linkage about an axle mounted on the rack in order to move said movable compacting platform upwardly towards the compacting bearing frame.

* * * * *